US005784934A

United States Patent [19]

Izumisawa

[11] Patent Number: 5,784,934

[45] Date of Patent: Jul. 28, 1998

[54] RATCHET WRENCH WITH PIVOTABLE HEAD

[75] Inventor: Osamu Izumisawa, Tokyo, Japan

[73] Assignee: Shinano Pneumatic Industries, Inc., Nagano Pref, Japan

[21] Appl. No.: 791,262

[22] Filed: Jan. 30, 1997

[51] Int. Cl.[6] ..... B25B 21/00

[52] U.S. Cl. ..... 81/57.26; 81/177.8; 81/57.13; 74/417

[58] Field of Search ..... 81/57.13, 57.26, 81/57.28, 57.29, 57.39, 177.8, 177.9, 177.7; 74/412 R, 416, 417; 403/84

[56] References Cited

U.S. PATENT DOCUMENTS

| | | | |
|---|---|---|---|
| D. 334,124 | 3/1993 | Izumisawa | D8/61 |
| D. 334,125 | 3/1993 | Izumisawa | D8/61 |
| 928,375 | 7/1909 | Frick . | |
| 978,395 | 12/1910 | Peters . | |
| 1,000,878 | 8/1911 | Allen . | |
| 1,019,825 | 3/1912 | Mossberg . | |
| 1,080,121 | 12/1913 | Oriol . | |
| 1,109,032 | 9/1914 | Bersted . | |
| 1,178,287 | 4/1916 | Anderson . | |
| 1,198,822 | 9/1916 | Capel . | |
| 1,265,535 | 5/1918 | Shannon . | |
| 1,324,258 | 12/1919 | Lewis | 81/57.26 |
| 1,325,407 | 12/1919 | Morgan . | |
| 1,568,442 | 1/1926 | Carver . | |
| 1,840,685 | 1/1932 | Witherup . | |
| 1,975,695 | 10/1934 | Lund | 81/177 |
| 2,073,903 | 3/1937 | O'Neil | 145/61 |
| 2,235,434 | 3/1941 | Kincaid | 81/58 |
| 2,268,802 | 1/1942 | Coffman | 74/396 |
| 2,498,465 | 2/1950 | Thomas | 145/66 |
| 2,499,569 | 3/1950 | Cooley | 64/17 |
| 2,501,217 | 3/1950 | Hawn | 64/2 |
| 2,669,147 | 2/1954 | Koenig | 81/119 |
| 2,705,897 | 4/1955 | Kentish | 81/58.2 |
| 2,791,142 | 5/1957 | Lyon | 81/57.26 |
| 2,881,884 | 4/1959 | Amtsberg | 192/30.5 |
| 2,921,773 | 1/1960 | Hoelzer | 254/129 |
| 3,256,758 | 6/1966 | Medesha | 81/57 |
| 3,605,914 | 9/1971 | Kramer | 173/93 |
| 3,661,217 | 5/1972 | Maurer | 173/93.5 |
| 3,779,107 | 12/1973 | Avery | 81/177.8 |
| 4,075,913 | 2/1978 | Tye | 81/177 |
| 4,171,651 | 10/1979 | Dacunto | 81/57.29 |
| 4,287,795 | 9/1981 | Curtiss | 81/57.26 |
| 4,296,654 | 10/1981 | Mercer | 81/57.26 |
| 4,299,145 | 11/1981 | Rautio et al. | 81/57.29 |
| 4,346,630 | 8/1982 | Hanson | 81/57.13 |

(List continued on next page.)

*Primary Examiner*—D. S. Meislin
*Attorney, Agent, or Firm*—Senniger, Powers, Leavitt & Roedel

[57] ABSTRACT

A power ratchet wrench including a handle for gripping and holding the wrench and a head having a ratchet mechanism including a drive shaft capable of powered rotation about its axis. The head and handle have openings generally in registration with each other. A pin is received through the openings, interconnects the handle and head and permits pivoting movement of the handle and head relative to each other about the transversely extending longitudinal axis of the pin to any of a multiplicity of selected relative angular orientations. The pin includes a first section sized and shaped for locking the handle and head together in fixed angular orientation about the pin axis and a second section sized and shaped for permitting free relative pivoting motion of the handle and head. The pin is mounted for sliding motion relative to the head and handle in a direction transverse of the handle and head between a locked position in which the first section of the pin engages the handle and head and locks them together and an unlocked position in which the first section does not interengage the handle and head so that the head and handle are unlocked for relative pivoting motion about the pin axis. The ratchet wrench further includes a transmission constructed to transmit power from the motor to the ratchet mechanism through the pin interconnection of the handle and head.

20 Claims, 3 Drawing Sheets

U.S. PATENT DOCUMENTS

| | | | |
|---|---|---|---|
| 4,406,186 | 9/1983 | Gummow | 81/60 |
| 4,530,261 | 7/1985 | Ventura | 81/177 |
| 4,530,262 | 7/1985 | Pownall | 81/177.9 |
| 4,552,544 | 11/1985 | Beckman et al. | 464/162 |
| 4,680,994 | 7/1987 | Singleton | 81/57.29 |
| 4,747,328 | 5/1988 | Howard | 81/54 |
| 4,748,872 | 6/1988 | Brown | 81/57.26 |
| 4,791,836 | 12/1988 | D'Haem et al. | 81/57.39 |
| 4,794,829 | 1/1989 | Mesenhoeller | 81/177.8 |
| 4,821,611 | 4/1989 | Izumisawa | 81/464 |
| 4,854,197 | 8/1989 | Walton | 81/57.39 |
| 4,856,385 | 8/1989 | Ogilvie et al. | 81/57.39 |
| 4,901,608 | 2/1990 | Shieh | 81/177.8 |
| 4,974,475 | 12/1990 | Lord et al. | 81/57.13 |
| 4,987,803 | 1/1991 | Chern | 81/57.39 |
| 4,993,288 | 2/1991 | Anderson et al. | 81/57.39 |
| 5,419,221 | 5/1995 | Cole | 81/60 |

RATCHET WRENCH WITH PIVOTABLE HEAD

BACKGROUND OF THE INVENTION

This invention relates generally to wrenches, and more specifically to a ratchet wrench having a pivotable head.

Wrenches having a straight fixed head are difficult to use in tight spaces which are often readily accessible by wrenches having a head located at an angled position relative to a body of the wrench. Presently available wrenches which have an adjustable head typically require the head to be moved away from the body to adjust the position of the head relative to the body. This is inconvenient since it generally requires two hands to adjust the head and requires the wrench to be moved away from the fastener the wrench is being used to loosen or tighten.

A separate but related problem, particularly associated with power wrenches is the transmission of power through a pivot point. A power wrench currently available with an adjustable head has a continuous flexible drive shaft extending from the body to the head. Since the shaft is subject to constant bending, the shaft is susceptible to fatigue over a period of time. The pivot connection of the head of the wrench to its body is structurally separate from the drive shaft, as is the mechanism for locking the head in a selected angular position relative to the body. Thus the wrench has several different parts required for pivoting, adding to the complexity and weight of the wrench.

Accordingly, there is presently a need for a pivotable ratchet wrench which is simple to adjust, compact and reliable.

SUMMARY OF THE INVENTION

Among the several objects of the invention may be noted the provision of a ratchet wrench which can access fasteners in hard to reach locations for loosening or tightening; the provision of such a ratchet wrench which is reconfigured by pivoting a head relative to a handle without translational movement between the head and handle; the provision of such a wrench which can transmit power through the pivot between the head and handle; the provision of such a ratchet wrench which is of relatively simple and sturdy construction; the provision of such a ratchet wrench which is reliable; the provision of such a ratchet wrench which is relatively light weight; and the provision of such a ratchet wrench which is economical to manufacture.

Generally, a ratchet wrench of this invention includes a handle for gripping and holding the wrench and a head. The head and handle have openings generally in registration with each other. A pin is received through the openings and extends transversely of the handle and head. The pin interconnects the handle and head and is adapted to permit pivoting movement of the handle and head relative to each other about the transversely extending longitudinal axis of the pin to any of a multiplicity of selected relative angular orientations. The head and handle are operatively interconnected to prevent relative translational movement between the head and handle in directions parallel to the longitudinal axis of the pin. The pin includes a first section sized and shaped for locking the handle and head together in fixed angular orientation about the pin axis and a second section sized and shaped for permitting free relative pivoting motion of the handle and head. The pin is mounted for sliding motion relative to the head and handle in a direction transverse of the handle and head between a locked position in which the first section of the pin engages the handle and head and locks them together, and an unlocked position in which the first section does not interengage the handle and head so that the head and handle are unlocked for relative pivoting motion about the pin axis.

In another aspect of the invention, the ratchet wrench described above is a power ratchet wrench having a drive shaft capable of powered rotation about its axis. The power ratchet wrench includes a motor disposed in the handle for driving the ratchet mechanism. A transmission is provided to transmit power from the motor to the ratchet mechanism through the pin interconnection of the handle and head.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
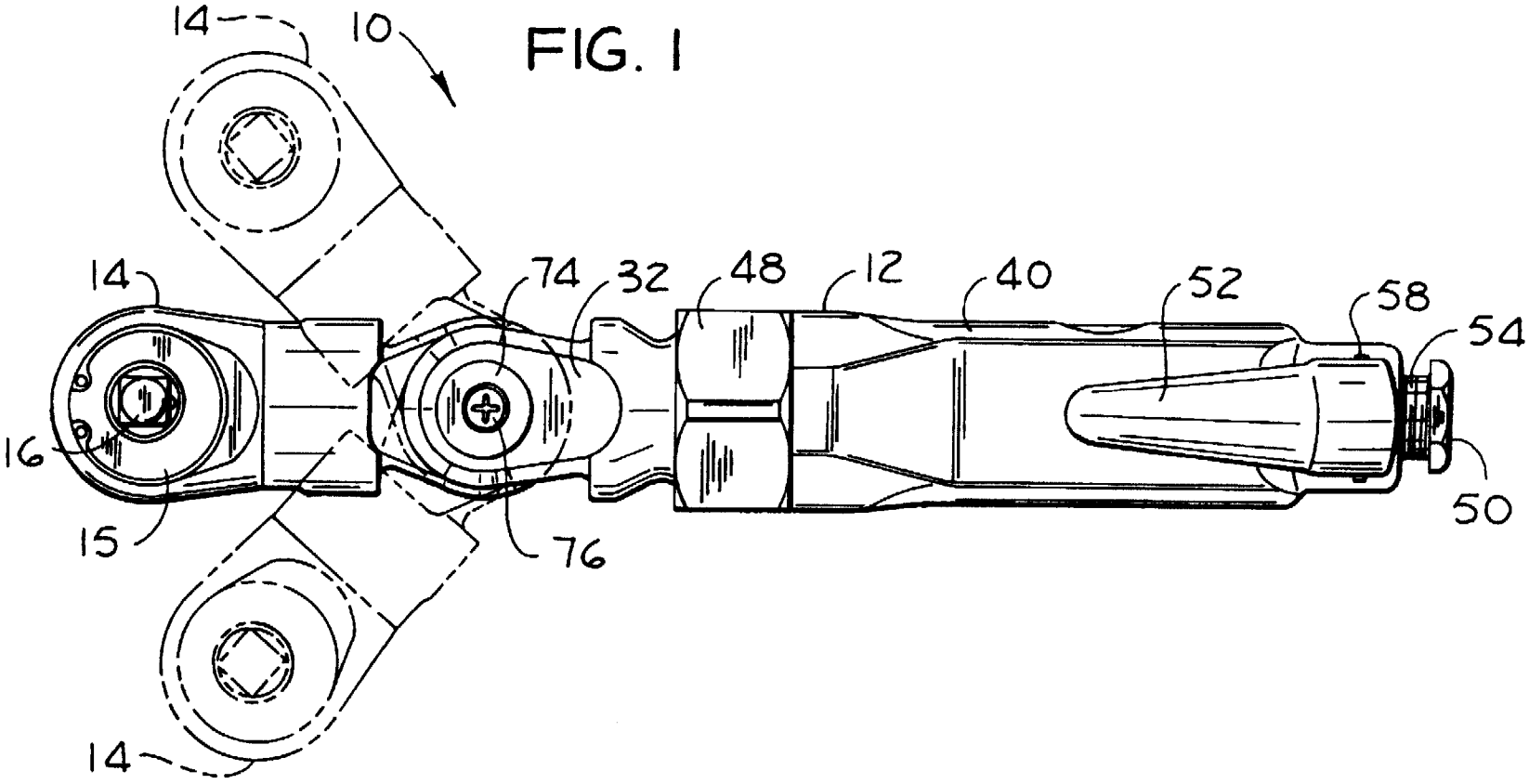
FIG. 1 is a front view of a ratchet wrench of this invention with a head of the wrench shown in phantom in two pivoted positions relative to a handle.
Figure 2:
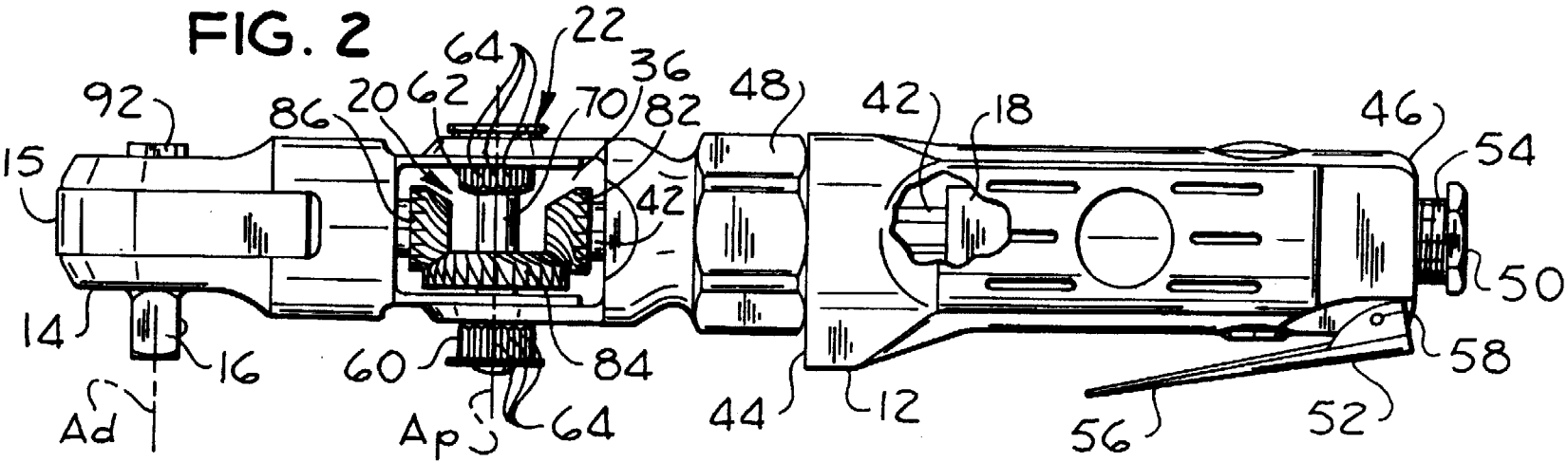
FIG. 2 is a side view of the ratchet wrench of FIG. 1 with parts broken away to show internal construction.

Referring now to the drawings, and first to FIGS. 1 and 2, a power driven ratchet wrench of the present invention is generally indicated at 10. The ratchet wrench 10 includes a handle 12 for gripping and holding the wrench and a head 14 having a ratchet mechanism 15 including a drive shaft 16 capable of powered rotation about its axis Ad. A motor 18 is disposed in the handle 12 for driving a transmission (generally indicated at 20) which in turn drives the ratchet mechanism 15. The ratchet mechanism 15 is of conventional construction, such as shown in U.S. Pat. No. 4,821,611, the disclosure of which is incorporated herein by reference.

The head 14 and handle 12 are operatively interconnected by a pin, generally indicated at 22, which is movable between an unlocked position (FIGS. 2 and 5) in which the pin permits pivoting movement of the handle and head relative to each other about the transversely extending longitudinal axis Ap of the pin to any of a multiplicity of selected relative angular orientations, and a locked position (FIG. 3) in which the head is held in a fixed angular orientation relative to the handle. The handle 12 and head 14 include openings 24, 26, respectively, generally in registration with each other for receiving the pin 22. The openings 24 in the handle 12 are formed in a first pair of spaced apart, generally parallel arms 32 extending axially from one end of the handle. The head 14 includes a second pair of spaced apart, generally parallel arms 34 having the openings 26 formed therein. The openings 24 in the first pair of arms 32 are aligned with the openings 26 in the second pair of arms 34 for receiving the pin 22. The second pair of arms 34 is sized to fit between and generally in engagement with the first pair of arms 32 extending from the handle 12. This arrangement of the arms 32, 34 prevents relative translational movement between the handle 12 and head 14 in a direction parallel to the longitudinal axis Ap of the pin 22. Each pair of arms 32, 34 are spaced apart from each other, and together define a cavity 36 for receiving the transmission 20 which will be further described below. It is to be understood that the arms 32, 34 may have configurations other than shown without departing from the scope of this invention.

The handle 12 includes a generally cylindrical hollow housing 40 for the motor 18 and a drive member 42 extending from the motor for driving the transmission 20 (FIG. 2). The exterior of the housing 40 has a generally continuous, smooth overall contour which may be comfortably gripped when the wrench 10 is in use. The housing 40 is preferably made of stainless steel or a similar strong, corrosion resistant metal. The handle 12 has a proximal end 44 located adjacent to the head 14 and a distal end 46 opposite the proximal end of the handle. A hex shaped coupling 48 is attached to the proximal end 44 of the handle 12 for connecting the first pair of arms 32 to the handle 12. It is to be understood that the arms 32 may also be integrally formed with the housing 40. The distal end 46 of the handle 12 includes an air inlet 50 for supplying pressurized air from an external pneumatic power source (not shown) to the pneumatically actuated motor 18 and a lever 52 (broadly, "actuation member") operable to allow air flow to enter the motor to drive the ratchet mechanism 15. The air inlet 50 comprises an air inlet connector 54 threadably engaged in the housing 40 for connecting the wrench 10 to a source of pressurized air so that the air inlet connector 54 supplies pressurized air to the motor 18. The lever 52 is pivotally mounted by a pin 58 on a rearward end of the housing 40. The lever 52 is biased toward a radially outward position with respect to the housing 40. The lever 52 may be squeezed to actuate a valve (not shown) to permit passage of pressurized air to the motor 18.

The motor 18 in the housing 40 is a standard air driven motor of the type commonly used in pneumatic tools. Although a pneumatic wrench is shown and described, the principles of the present invention are generally applicable to a power ratchet wrench driven by an electric motor. The wrench may also be manually driven instead of power driven without departing from the scope of this invention.

Figure 5:
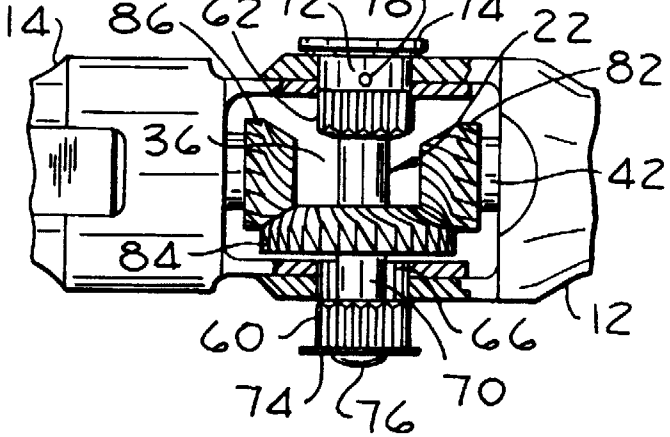
FIG. 5 is a fragmentary side view of the ratchet wrench shown in partial section with the head and handle in an unlocked position.

Pivoting of the head 14 to a selected position relative to the handle 12 is achieved through the construction and operation of the pin 22 interconnecting the head and handle. The pin 22 has first sections 60, 62 sized and shaped for locking the handle 12 and head 14 together in fixed angular orientation about the longitudinal axis Ap of the pin and second sections 70, 72 sized and shaped for permitting free relative pivoting motion of the handle and head. The pin 22 is mounted in the openings 24, 26 in the arms 32, 34 for sliding motion relative to the handle 12 and head 24 along its axis Ap. The pin 22 is slidable in directions transverse of the handle 12 and head 14 between its locked position in which the first sections 60, 62 of the pin engage the handle and head and locks them together (FIG. 3) and its unlocked position in which the first section does not interengage the handle and head so that the head and handle are free for relative pivoting motion about the pin axis Ap (FIG. 5).

Figure 3:
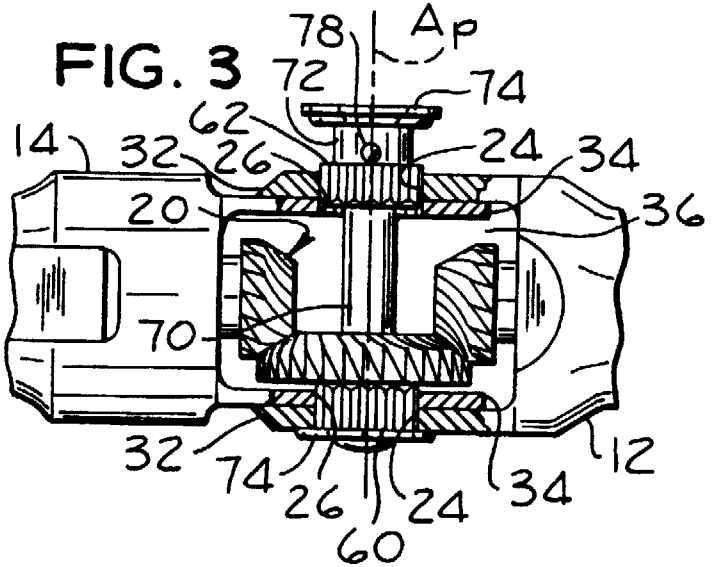
FIG. 3 is a fragmentary side view of the ratchet wrench of FIG. 1 shown in partial section with the head and handle in a locked position.
Figure 6:
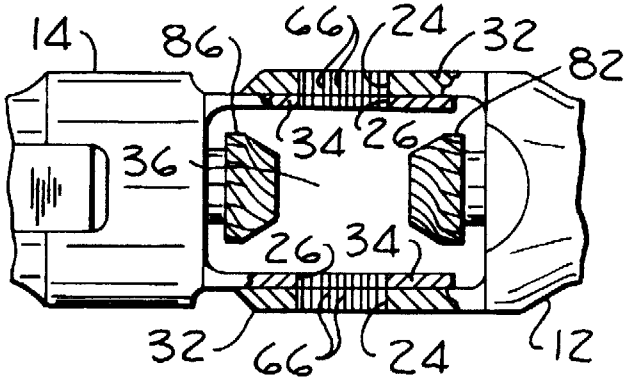
FIG. 6 is a fragmentary, partially sectional side view of the ratchet wrench with a connecting pin and a second bevel gear removed to show detail.

The first section 60 is located adjacent one end of the pin 22 and the second section 62 is located near an opposite end of the pin. Each enlarged first section 60, 62 has external splines 64 formed thereon. As shown in FIG. 6, the openings in the handle 12 and head 14 have corresponding internal notches 66 (splines) for mating with the external splines 64 located on the enlarged first sections 60, 62 of the pin 22 when the pin is in its locked position. The length of each first section 60, 62 is generally the same as the length of the opening 24 in one of the arms 32 of the handle 12 plus the length of the opening 26 in one of the arms 34 of the head 14 so that external splines 64 engage the internal notches 66 in the openings in both the head and handle to lock the head in a fixed angular position relative to the handle. The first and second spline sections 60, 62 are spaced apart such that when the pin 22 is moved upward, as shown in FIG. 3, the first spline section 60 is disposed within the openings 24, 26 in one of the arms 32 of the handle 12 and the adjacent arm 34 of the head 14, and the second spline section 62 is disposed in the openings 24, 26 in the other arms of the handle and head. The first sections 60, 62 may be integrally formed with the pin 22 or formed separately from the pin and fixedly attached to the pin. The pin 22 and first sections 60, 62 are preferably formed from steel or other suitable metal. The external splines 64 of the spline sections 60, 62 and internal notches 66 of the openings 24, 26 are preferably formed from the same or compatible materials. Although two first sections 60, 62 are preferred, a single splined section may be employed without departing from the scope of this invention.

The second sections 70, 72 of the pin have a generally smooth cylindrical surface such that when the pin is in its unlocked position the smooth surface is disposed within the openings 24, 26 in the arms of the handle 12 and head 14. The first smooth section 70 is interposed between the first and second spline sections 60, 62 of the pin 22. The first smooth section 70 is sized smaller than the other sections of the pin 22 for insertion into a portion of the transmission 20 (as will be described below). The second smooth section 72 is located at one end of the pin adjacent to the second spline section 62. The second enlarged, smooth section 72 has a diameter only slightly smaller than the spline sections 60, 62 so that the smooth section of the pin 22 is not free to move radially within the openings 24, 26 in the arms 32, 34 in the unlocked position to prevent wobbling of the handle 12 and head 14 as the head is pivotally adjusted. Thus, even when the pin 22 is in its unlocked position the head 14 is held from movement axially of the handle 12.

In order to adjust the angular position of the head 14 relative to the handle 12, the pin 22 is moved to its unlocked position, the head 14 is pivoted to a selected position and the pin is moved back to its locked position. There is no need to move the head 14 and handle 12 apart prior to pivoting the head. Thus, adjustment of the head 14 is in most instances may be accomplished with one hand by simply sliding the pin 22 to its unlocked position and repositioning the head. Furthermore, it is not necessary to remove the head 14 from a socket and fastener the wrench 10 is being used to tighten or loosen prior to adjusting the position of the head relative to the handle 12.

The pin 22 has a stop 74 on each end to limit the travel of the pin along its longitudinal axis Ap and retain the pin in the openings 24, 26. The stops 74 help to provide a positive location of the pin in its locked and unlocked positions. One of the stops 74 is a generally annular disk attached to the pin by a screw 76. The other one of the stops 74 is formed integrally with the pin 22. The pin 22 further includes a conventional ball spring detent 78 for engagement with at least one of the arms 32, 34 of the handle 12 and head 14 in both the locked and unlocked positions of the pin 22 to prevent the pin from slipping within the openings 24, 26. The detent 78 is located on the second section 72 of the pin 22.

Figure 4:
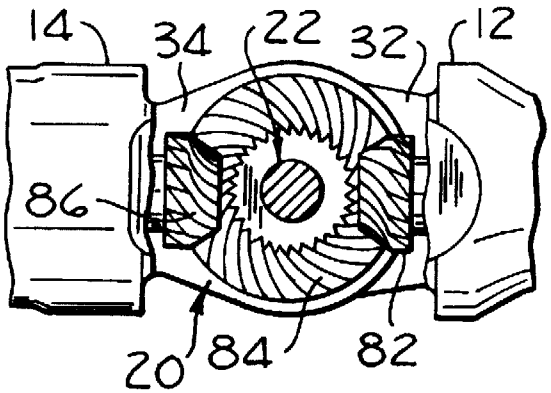
FIG. 4 is a fragmentary rear view of the ratchet wrench with parts removed to show detail.

The transmission 20 is constructed to transmit power from the motor 18 to the ratchet mechanism 15 through the pin 22 interconnecting of the handle 12 and head 14. The transmission 20 includes three bevel gears 82, 84, 86 (FIG. 4). The first bevel gear 82 is connected to the drive member 42 extending from the motor 18 and is mounted on the handle 12 for rotation relative to the handle. The first bevel gear 82 extends axially outward from the handle 12 into the cavity 36 defined by the arms 34. A second bevel gear 84 has a central opening formed therein for receiving the pin 22 such that the second gear is free to rotate around the pin and the pin is free to slide axially through the gear. The second bevel gear 84 also helps to hold the head 14 and handle 12 against translational axial movement when the pin 22 is in its unlocked position. A third bevel gear 86 is connected to the ratchet mechanism 15 and mounted on the head 14 for rotation relative to the head and spaced from the first bevel gear 82. The third bevel gear 86 extends axially outwardly from the head 14 into the cavity 36 defined by the arms 34. The first and third bevel gears 82, 86 rotate about axes generally perpendicular to the longitudinal axis Ap of the pin 22 and the second bevel gear 84 rotates about the longitudinal axis of the pin. The first and third bevel gears 82, 86 are enmeshed with the second bevel gear 84 for transmitting power from the first gear through the second gear to the third gear for driving the ratchet mechanism 15 (see FIGS. 3 and 4). Since the pin 22 is free to slide through the second bevel gear 84, the gear remains in contact with the first and third gears 82, 86 as the pin moves along its central longitudinal axis Ap from its locked position to its unlocked position and vice versa. The second gear 84 is also free to rotate about the pin 22 so that the pin remains stationary as the second gear rotates to drive the third gear 86. As the head 14 is pivoted relative to the handle 12, the third gear 86 moves along the periphery of the second gear 84, but remains continually enmeshed with the second gear. The first gear 82 also remains continually enmeshed with the second gear 84 as the head 14 is pivoted relative to the handle 12. The arrangement of the gears 82, 84, 86 permits operation of the transmission 20 with the head 14 positioned at various angular orientations relative to the handle 12.

The ratchet mechanism 15 is contained within the head 14 and is a conventional ratchet system which includes the drive shaft 16 and a ratchet direction selector 92. The ratchet direction selector 92 can be positioned to rotate the drive shaft 16 to drive a connected socket (not shown) clockwise or counterclockwise about the axis Ad of the drive shaft. The drive shaft 16 extends laterally outwardly from the head 14 and is adapted to releasably hold the socket for conjoint rotation of the socket with the drive shaft so as to tighten or loosen a fastener such as a nut or bolt (not shown).

Figure 7:
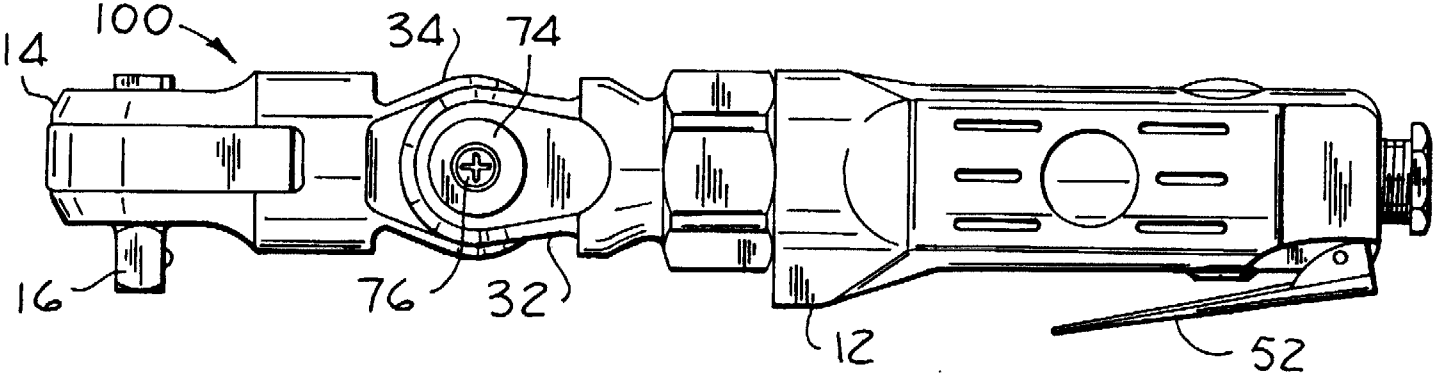
FIG. 7 is side view of a second embodiment of a ratchet wrench of this invention.

A second embodiment of the present invention, generally indicated at 100, is shown in FIG. 7. The wrench 100 is similar in configuration to the wrench 10 of the first embodiment except that the head 14 and handle 12 are configured for pivotal movement of the head relative to the handle in a forward and rearward direction in relation to the face of the head, rather than a side to side pivotal movement as with the first embodiment. This configuration may be used in tight spaces in which side to side pivotal movement of the head 14 relative to the handle 12 does not provide the necessary access to the fastener which is being tightened to loosened.

It is to be understood that the above described pivotable head 14 of the first or second embodiments may be used on various types of power driven tools or manually operated tools and tools other than ratchet wrenches without departing from the scope of this invention.

In operation, power is applied by actuation of the lever 52 to allow pressurized air to flow into the motor 18 to cause rotation of the motor. The motor 18 turns the drive member 42 which in turn rotates the first bevel gear 82. The first bevel gear 82 drives the third bevel gear 86 through the second bevel gear 84. The third bevel gear 86 drives the drive shaft 16 which rotates about its axis Ad to turn a socket (not shown) attached to the drive shaft for tightening or loosening a fastener. Upon release of the lever 52, the air supply is cut off from the motor 18 and the drive shaft 16 stops rotating. To change the position of the head 14 relative to the handle 12, the pin 22 is moved to its unlocked position (FIG. 5) and the head is pivoted to its selected position. When the pin 22 is in its unlocked position, the second bevel gear 84 remains in contact with the first and third bevel gears 82, 86 and the second smooth section 72 of the pin engages the arms 32, 34 in the openings 24, 26 in the arms 32, 34 so that the head 14 is held from pivoting about any axis other than the longitudinal axis Ap of the pin. Thus, the head 14 does not wobble when the pin 22 is in its unlocked position. The pin 22 is then moved back to its locked position to fix the head 14 in a selected angular orientation relative to the handle 12. There is no translational movement at any time between the head 14 and handle 12 in directions parallel or perpendicular to the longitudinal axis Ap of the pin.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A power ratchet wrench comprising:

a handle for gripping and holding the wrench;

a head having a ratchet mechanism including a drive shaft capable of powered rotation about its axis;

the head and handle having openings generally in registration with each other;

a motor disposed in the handle for driving the ratchet mechanism;

a pin received through the openings and extending transversely of the handle and head, the pin interconnecting the handle and head and being adapted to permit pivoting movement of the handle and head relative to each other about the transversely extending longitudinal axis of the pin to any of a multiplicity of selected relative angular orientations;

the head and handle being operatively interconnected to prevent relative translational movement between the head and handle in directions parallel to the longitudinal axis of the pin;

the pin including a first section sized and shaped for locking the handle and head together in fixed angular orientation about the pin axis and a second section sized and shaped for permitting free relative pivoting motion of the handle and head, the pin being mounted for sliding motion relative to the head and handle in a direction transverse of the handle and head between a locked position in which the first section of the pin interengages the handle and head and locks them together, and an unlocked position in which the first section does not interengage the handle and head so that the head and handle are unlocked for relative pivoting motion about the pin axis; and a transmission constructed to transmit power from the motor to the ratchet mechanism through the pin interconnection of the handle and head.

2. A power ratchet wrench as set forth in claim 1 wherein said transmission includes a first bevel gear connected to the motor and mounted on the handle for rotation relative to the handle, a second bevel gear having a central opening formed therein for receiving the pin such that the second gear is free to rotate around the pin and slide along the longitudinal axis of the pin, and a third bevel gear connected to the ratchet mechanism and mounted on the head for rotation relative to the head and spaced from said first bevel gear, said first and third bevel gears being enmeshed with said second bevel gear for transmitting power from said first gear through said second gear to the third gear for driving the ratchet mechanism.

3. A power ratchet wrench as set forth in claim 2 wherein said pin includes a stop on each end of the pin to limit the travel of the pin along the longitudinal axis of the pin.

4. A power ratchet wrench as set forth in claim 2 wherein said first section of the pin comprises a first enlarged section located adjacent one end of the pin and a second enlarged section located near an opposite end of the pin, each enlarged section having external splines formed therein and wherein said openings in the head and handle include corresponding internal notches for mating with said external splines located on the pin when the pin is in its locked position, said second section of the pin comprising a generally smooth cylindrical surface located so that when the pin is in its unlocked position the smooth surface is disposed within the openings of the head and handle.

5. A power ratchet wrench as set forth in claim 2 wherein said handle comprises a proximal end located adjacent the head, a distal end opposite the proximal end, and a first pair of spaced apart generally parallel arms extending forward from the proximal end of the handle, the first pair of arms having the openings for receiving the pin formed therein.

6. A power ratchet wrench as set forth in claim 5 wherein said head comprises a second pair of spaced apart generally parallel arms sized to fit within and generally adjacent to the first pair of arms extending from the handle, the second pair of arms having the openings for receiving the pin formed therein and aligned with the openings in the first pair of arms.

7. A power ratchet wrench as set forth in claim 2 wherein the ratchet wrench is pneumatically actuated and wherein said handle includes an air inlet for supply of pressurized air to the handle and an actuation member operable to allow air flow to enter the motor to drive the ratchet mechanism.

8. A power ratchet wrench comprising:

a handle for gripping and holding the wrench;

a head having a ratchet mechanism including a drive shaft capable of powered rotation about its axis;

a motor disposed in the handle for driving the ratchet mechanism;

a pin received through and extending transversely of the handle and head, the pin interconnecting the handle and head and being adapted to permit pivoting movement of the handle and head relative to each other about the transversely extending longitudinal axis of the pin to any of a multiplicity of selected relative angular orientations;

a transmission constructed to transmit power from the motor to the ratchet mechanism through the pin interconnection of the handle and head, the transmission comprising a first gear connected to the motor and mounted on the handle for rotation relative to the handle, a second gear enmeshed with the first gear and mounted on the pin for rotation on the axis of the pin, and a third gear enmeshed with the second gear and connected to the ratchet mechanism, the third gear being mounted on the head for rotation relative to the head, the first, second and third gears being constructed to remain enmeshed as the head and handle pivot relative to one another about the pin axis.

9. A power ratchet wrench as set forth in claim 8 wherein said first, second and third gears are bevel gears.

10. A power ratchet wrench as set forth in claim 8 wherein said second gear is rotatable about the pin and slidable along the longitudinal axis of the pin.

11. A power ratchet wrench as set forth in claim 8 wherein said pin is mounted in the head and handle for sliding motion relative to the head and handle in a direction transverse of the handle and head between a locked position in which a first section of the pin engages the handle and head and locks them together, and an unlocked position in which the first section does not interengage the handle and head so that the head and handle are unlocked for relative pivoting motion about the pin axis.

12. A power ratchet as set forth in claim 11 wherein said handle includes a first pair of spaced apart generally parallel arms extending forward from one end of the handle, the first pair of arms having openings formed therein for receiving the pin.

13. A power ratchet wrench as set forth in claim 12 wherein said head includes a second pair of spaced apart generally parallel arms sized to fit within and generally adjacent to the first pair of arms, the second pair of arms having openings aligned with the openings in the first pair of arms for receiving the pin.

14. A power ratchet wrench as set forth in claim 13 wherein said pin comprises a first enlarged section located adjacent one end of the pin and a second enlarged section located near an opposite end of the pin, each enlarged section having external splines formed therein and wherein said openings in the head and handle include corresponding internal notches for mating with said external splines located on the pin when the pin is in its locked position, said second section of the pin comprising a generally smooth cylindrical surface located so that when the pin is in its unlocked position the smooth surface is disposed within the openings of the head and handle.

15. A power ratchet as set forth in claim 14 wherein said pin includes a stop on each end of the pin to limit the travel of the pin along the longitudinal axis of the pin.

16. A power ratchet as set forth in claim 8 wherein the ratchet wrench is pneumatically actuated and the handle includes an air inlet for supply of pressurized air to the handle and an actuation member operable to allow air flow to enter the motor to drive the ratchet mechanism.

17. A wrench comprising:

a handle for gripping and holding the wrench;

a head;

the head and handle having openings generally in registration with each other; and a pin received through the openings and extending transversely of the handle and head, the pin interconnecting the handle and head and being adapted to permit pivoting movement of the handle and head relative to each other about the transversely extending longitudinal axis of the pin to any of a multiplicity of selected relative angular orientations;

the head and handle being operatively interconnected to prevent relative translational movement between the head and handle in directions parallel to the longitudinal axis of the pin;

the pin including a first section sized and shaped for locking the handle and head together in selected ones of a plurality of angular orientations about the pin axis and a second section sized and shaped for permitting free relative pivoting motion of the handle and head, the pin being mounted for sliding motion relative to the head and handle in a direction transverse of the handle and head between a locked position in which the first section of the pin engages the handle and head and locks them together, and an unlocked position in which the first section does not interengage the handle and head so that the head and handle are unlocked for relative pivoting motion about the pin axis.

18. A wrench as set forth in claim 17 wherein said first section of the pin comprises a first enlarged section located adjacent one end of the pin and a second enlarged section located near an opposite end of the pin, each enlarged section having external splines formed therein and wherein said openings in the head and handle include corresponding internal notches for mating with said external splines located on the pin when the pin is in its locked position and wherein said second section of the pin comprises a generally smooth cylindrical surface located so that when the pin is in its unlocked position the smooth surface is located within the openings of the head and handle.

19. A wrench as set forth in claim 18 wherein said handle includes a first pair of spaced apart generally parallel arms extending from one end of the handle, the openings in the handles formed in the first pair of arms, and wherein said head includes a second pair of spaced apart generally parallel arms sized to fit within and generally adjacent to the first pair of arms, the openings in the head being formed in the second pair of arms and aligned with the openings in the first pair of arms for receiving the pin.

20. A wrench as set forth in claim 18 wherein said pin includes a stop on each end of the pin to limit the travel of the pin along the axis.

* * * * *